United States Patent [19]

Johnson et al.

[11] Patent Number: 4,669,977

[45] Date of Patent: Jun. 2, 1987

[54] ROTATING RABBLED ROOF DRYING AND HEATING FURNACE

[75] Inventors: Beverly E. Johnson; William E. Solano, both of Pittsburgh, Pa.

[73] Assignee: Salem Furnace Co., Pittsburgh, Pa.

[21] Appl. No.: 843,674

[22] Filed: Mar. 25, 1986

[51] Int. Cl.[4] ..... F27B 9/16

[52] U.S. Cl. ..... 432/139; 432/153

[58] Field of Search ..... 432/139, 140, 141, 142, 432/152, 153

[56] References Cited

U.S. PATENT DOCUMENTS

| | | | |
|---|---|---|---|
| 1,549,379 | 8/1925 | Pike | 432/139 |
| 1,603,442 | 10/1926 | Balz | 432/153 |
| 1,836,002 | 12/1931 | Balz | 432/139 |
| 3,448,012 | 6/1969 | Allred | 201/27 |
| 3,740,184 | 6/1973 | Oleszko | 432/139 |
| 3,763,011 | 10/1973 | Allred | 432/139 |
| 4,046,086 | 9/1977 | von Dreusche, Jr. | 432/139 |
| 4,215,981 | 8/1980 | von Dreusche, Jr. | 432/139 |

*Primary Examiner*—Henry C. Yuen

*Attorney, Agent, or Firm*—Buell, Ziesenheim, Beck & Alstadt

[57] ABSTRACT

Apparatus for drying and heating wet particulate materials comprises a furnace with stationary circular hearth and sidewalls and a rotating roof. The hearth is perforated to receive hot gases from a plenum chamber below it, which gases are drawn off from the hearth through conduit openings out of its sidewalls, the major portion of the gases are externally heated, and are returned to the hearth through the plenum chamber. A feed bin is positioned on the roof at its center and through a conveyor feeds charged material onto the hearth through an opening in the roof near its outside edge. Rabbles are mounted in the roof to move the charge toward the center of the hearth as the roof rotates. From the center of the hearth a soaking pit extending through the plenum chamber discharges the heated material.

8 Claims, 4 Drawing Figures

ROTATING RABBLED ROOF DRYING AND HEATING FURNACE

FIELD OF THE INVENTION

This invention relates to furnaces for drying and heating particulate materials such as coal, coke, shale, culm, lignite, petroleum coke and the like. It is more particularly concerned with a culm heating and drying furnace having a stationary circular hearth, means for introducing heating gas through the hearth and a rotary roof carrying rabbles.

BACKGROUND OF THE INVENTION

Rotary hearth furnaces for the coking of coal and the calcining of coal or petroleum coke are well known. In such furnaces the charge is usually heated by combustion in the furnace chamber of some or all of the volatile matter there evolved and rabbles in the stationary roof are adjusted to deflect the heated charge into a central soaking pit or zone as the hearth rotates. Such furnaces are satisfactory for charge materials which produce sufficient combustible volatiles for the necessary heat and the particulate material is heated primarily by radiation but are not well suited for heating wet charges or materials deficient in combustible volatiles when the particulate material is heated primarily by convection. It is a principal object of our invention to provide a furnace for such materials, specifically culm.

SUMMARY OF THE INVENTION

Our furnace to be described in detail hereinafter has a stationary circular hearth and sidewalls and a rotary roof sealed to the sidewalls by conventional means. The hearth is perforated and is superimposed on a plenum chamber. The heating gas is injected in the bottom plenum chamber and after it passes through the material to be heated, it is withdrawn through the upper sidewall. This gas may be reheated and reused or it may be cleaned and discharged to the atmosphere. A feed hopper or bin is supported on the furnace roof and feeds into a conveyor mounted on the roof which carries the charge material to the circumference of the roof where it is discharged through an opening in the roof onto the hearth. Rabbles mounted in the roof cause the charge to travel toward a discharge port in the center of the hearth and into a soaking pit extending downwardly therefrom.

DESCRIPTION OF PREFERRED EMBODIMENTS

Figure 1:
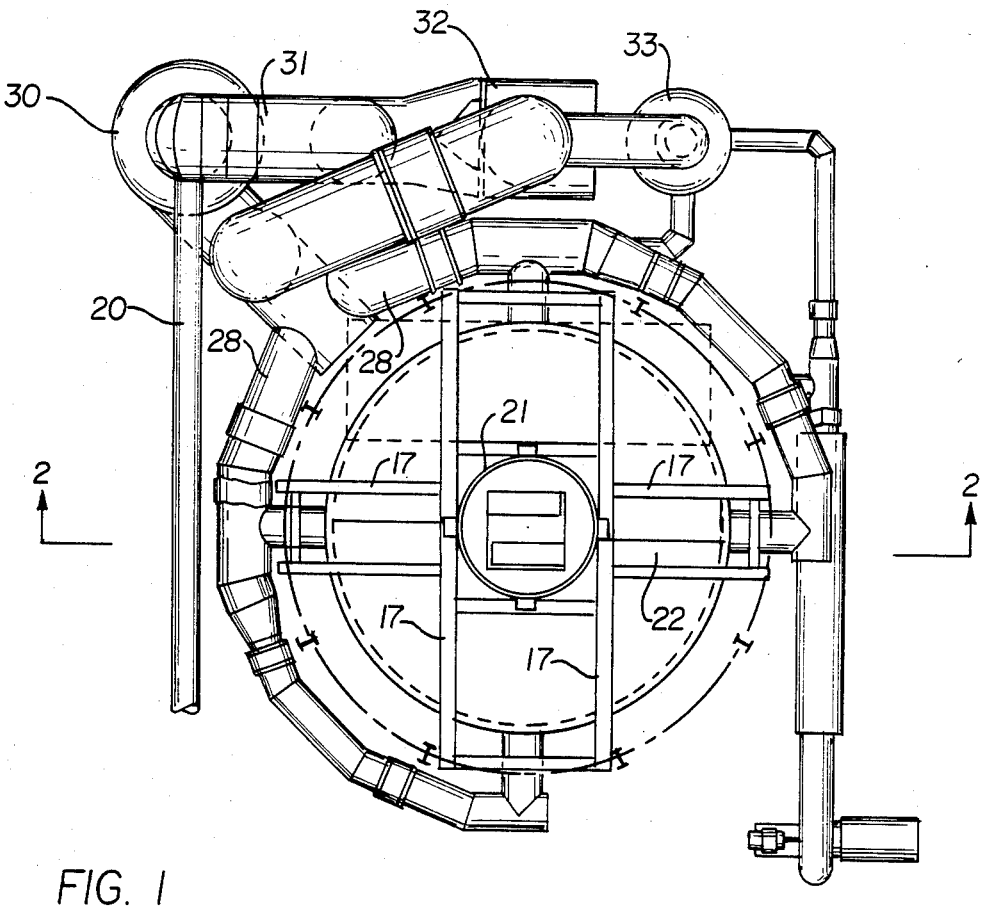
FIG. 1 is a plan of our apparatus.
Figure 2:
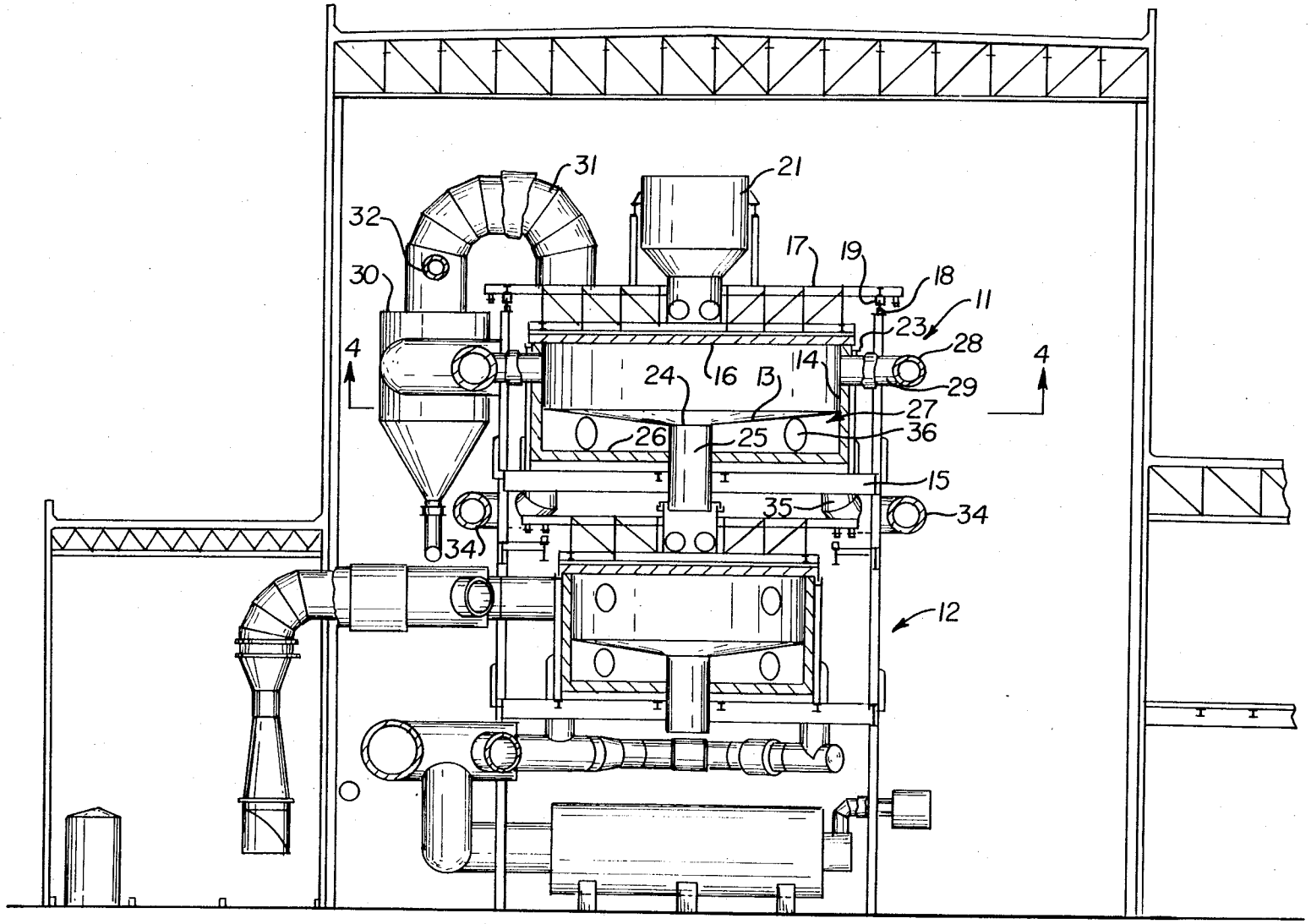
FIG. 2.is a vertical section through the apparatus of FIG. 1 taken on the plane 2—2.
Figure 4:
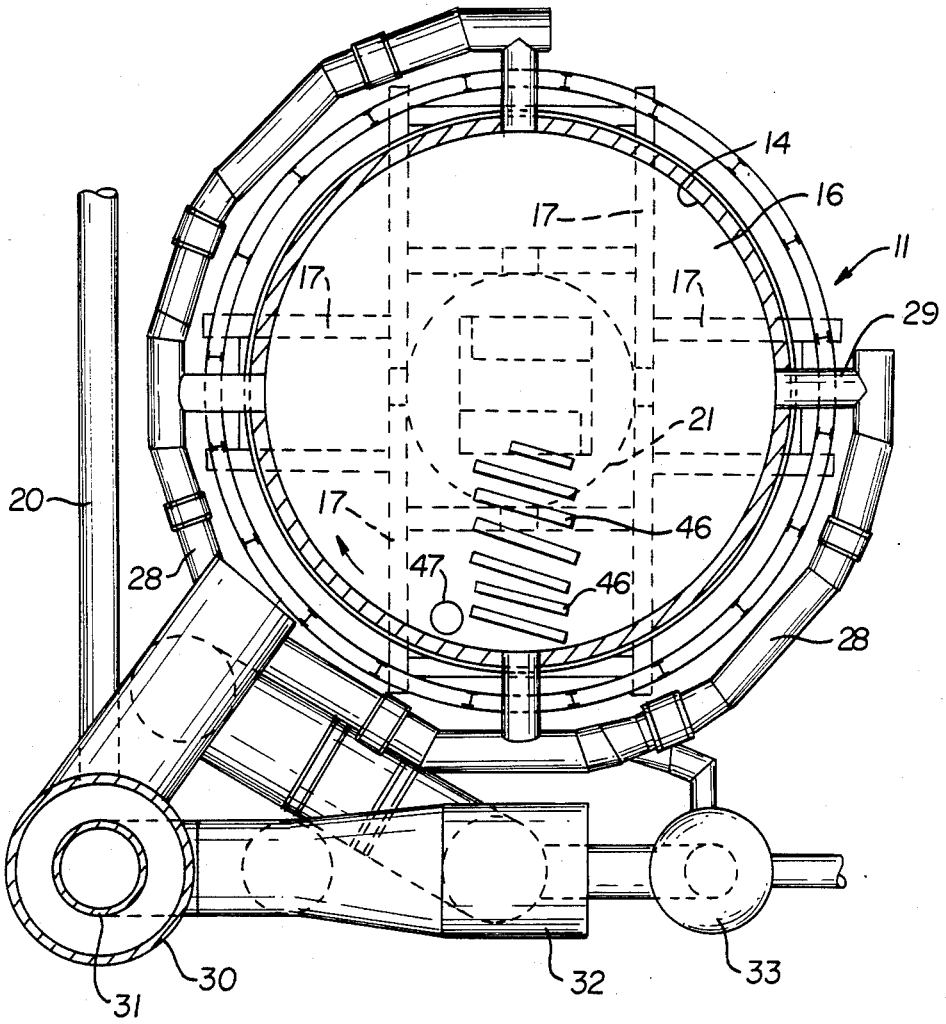
FIG. 4 is a detail on the plane 4—4 of FIG. 2 showing the rabble arrangement.

A presently preferred embodiment of our invention is shown in FIGS. 1, 2 and 4. The installation is for a plant treating culm, that is, wet coal, to dry it and partially devolatilize it so as to obtain hot char at a temperature of about 1000° F., off-gas that contains combustible volatile constituents, and oils from the gases and vapor evolved.

The operation is carried out in two very similar pieces of superimposed apparatus 11 and 12, denominated dryer and pyrolyzer respectively. Dryer 11 comprises a stationary circular hearth 13 surrounded by a cylindrical wall 14 both of which are supported by steelwork 15 well above ground level. Dryer 11 has a circular roof 16 suspended from structural members 17 which members have wheels 19 which travel on a circular track 18. Track 18 is supported by steelwork 15 which is external to wall 14. A cylindrical feed bin 21 is also supported by structural members 17 above the center of roof 16. From the bottom of feed bin 21 a closed screw conveyor 22 extends diametrically along roof 16 to its circumference and terminates over an opening 47 in roof 16, shown in FIG. 4. Roof 16 is sealed around its circumference to wall 14 by a conventional liquid or sand seal 23 which prevents escape of gas through the rotating barrier so formed, and is rotated by conventional means, not shown.

Hearth 13 slopes downwardly all around to a central discharge port 24 from which a cylindrical soaking pit 25 depends. Hearth 13 is perforated to allow gases to pass therethrough as will be described more fully hereinafter. Below hearth 13 wall 14 extends to a bottom element 26 so as to form a plenum chamber 27. Soaking pit 25 passes through that plenum chamber and bottom element 26. One or more offtake pipes 29 opening from the hearth through wall 14 connect with manifold 28 which delivers offtake gases to cyclone separator 30, the cleaned gas from which is withdrawn through conduit 31. The bulk of the offtake gases is circulated by fan 32 through a fuel-fired heater or combustor 33 to a manifold 34 from which delivery conduits 35 open at 36 in the wall of the plenum chamber 27.

Pyrolyzer 12 is likewise a stationary hearth rotating roof furnace identical in design with dryer 11 but somewhat smaller in scale. Its feed bin receives the dried culm from the soaking pit of dryer 11 and that culm is partially devolatilized by heating it with hot gas to a temperature higher than that reached in the dryer 11. It also has means like those of dryer 11 for withdrawing gases from the furnace chamber, heating them and introducing them into its plenum chamber.

Figure 3:
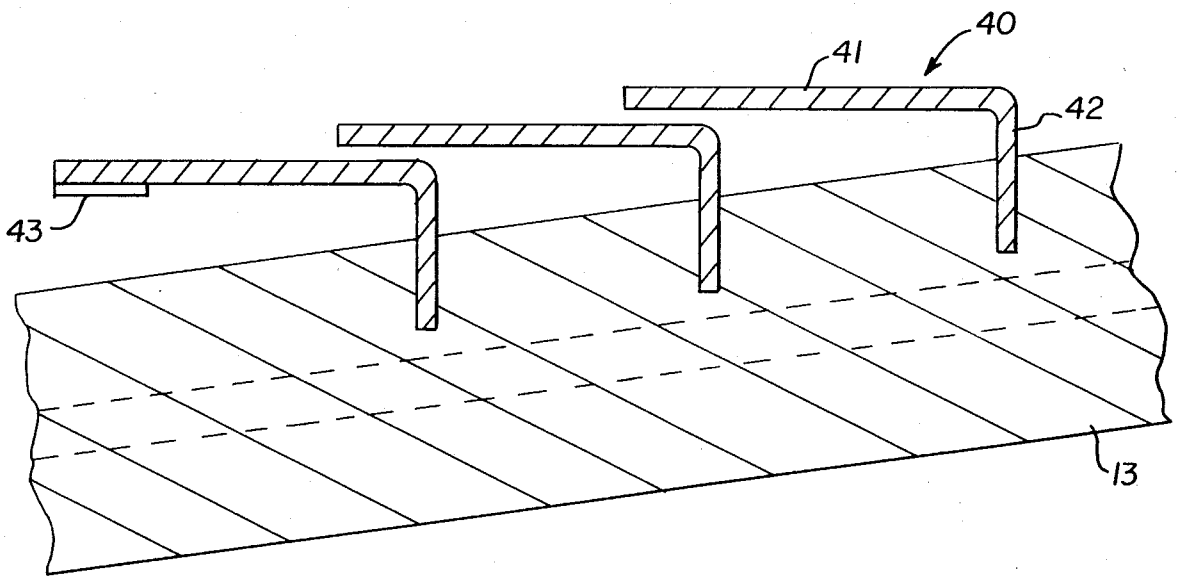
FIG. 3 is a detail in vertical section of the hearth structure.

The perforated hearth structure of our invention is shown in detail in FIG. 3. Arcuate elements 40 having a wide flange 41 and a narrow flange 42 normal thereto are set in hearth 13 to form concentric rings so that wide flanges 41 partially overlap each other from the circumference of the hearth toward its center. The spacing between overlapped flanges 41 is fixed by spacers 43 affixed to the underside of flanges 41 at intervals along their free edges. That spacing is made large enough to allow the passage of gas but not so large that most charge particles can escape therethrough. Hearth 13 slopes downwardly toward its center opening 24 as has been mentioned and elements 40 may be set in the hearth so that flanges 41 slope the same way. Any particles small enough to pass through the space between overlapped flanges 41 would have to travel uphill against the flow of gas from plenum chamber 27.

A series of rabbles 46 fixed in roof 16 one after another along a radius of the roof and depending therefrom is shown in plan in FIG. 4. The direction of rotation of roof 16 is indicated by the arrow. Opening 47 from screw conveyor 22 previously described herein is located in roof 16 near its outer edge and behind outermost rabbles 46 in the direction of rotation. Rabbles 46 are positioned to move the charge on hearth 13 toward the center as roof 16 is rotated. The outermost rabbles 46 clear the charge off the outermost rings of hearth 13 and additional charge is deposited thereon through opening 47. The rabbles are of conventional design. Pyrolyzer 12 is likewise furnished with rabbles as here described. More than one series of rabbles may be employed.

As air and fuel are introduced into dryer combustor 33 to heat the dryer-off gases the volume of off-gases is increased thereby. Balance is maintained by withdrawing a fraction of those off-gases through conduit 20 shown in FIG. 1. A portion of the off-gases may be treated to recover oils therefrom.

The apparatus here described was designed to dry and pyrolyze culm of the following approximate analysis by weight.

| Water | Fixed Carbon |
|---|---|
| 20.6% | 39.31% |
| Volatiles | Ash |
| 30.4% | 10.01% |

The gases withdrawn from dryer 11 are at an average temperature of about 275° F. They are heated in combustor 33 and reintroduced into dryer 11 through plenum chamber 27 at a temperature of about 575° F.

Culm is discharged from dryer 11 to pyrolyzer 12 at an average temperature of about 400° F. and with substantially zero moisture content. In pyrolyzer 12 gases are withdrawn at about 800° F., reheated to about 1050° F. and reintroduced through the plenum chamber and perforated hearth into the culm. The culm, discharged from the pyrolyzer at a temperature of about 1000° F., is eventually burned in a fluidized bed boiler.

Although we have described and illustrated two furnaces in tandem one furnace alone is suitable for drying and heating many particulate materials.

We claim:

1. A furnace for drying and heating particulate materials comprising a stationary perforated hearth, a wall affixed to said hearth thereabove, a plenum chamber affixed to said hearth therebelow, a rotatable roof positioned above said wall, means for rotating said roof, rotatable means sealing said roof to said wall, a central discharge port in said hearth, means or supplying hot gases to said plenum chamber, means mounted on said roof for charging particulate materials onto said hearth and rabbles mounted in said roof positioned to move said particulate material across said hearth into said discharge port when said roof is rotated, said perforated hearth slopes downwardly toward said central discharge port and comprises concentric flat rings spaced vertically from one another around their inside edges sufficiently to prevent passage therebetween of substantial amounts of said particulate material.

2. Apparatus of claim 1 including a circular track around said wall, structural means external of said furnace wall supporting said track, means supporting said rotatable roof on said track and means affixed to said structural means for rotating said roof on said track.

3. Apparatus of claim 1 including openings in said wall and duct means for withdrawing heated gases from said hearth through said openings.

4. Apparatus of claim 1 including a soaking pit positioned below said hearth port and extending through said plenum chamber.

5. Apparatus of claim 1 in which the means for charging particulate material onto said hearth comprise a fuel bin mounted on said roof at its center, a charging opening in

6. Apparatus of claim 1 in which said rabbles are mounted one after another along a radius of said roof and in which said charging opening in said roof is angularly displaced from said radius in following relation thereto.

7. Apparatus of claim 1 in which said means for supplying hot gases includes duct means for circulating said gases withdrawn from said hearth into said plenum chamber.

8. Apparatus of claim 7 in which said means for circulating said gases include heating means for increasing the temperature of said gases.

* * * * *

UNITED STATES PATENT AND TRADEMARK OFFICE

CERTIFICATE OF CORRECTION

PATENT NO. : 4,669,977

DATED : June 2, 1987

INVENTOR(S) : BEVERLY E. JOHNSON AND WILLIAM E. SOLANO

It is certified that error appears in the above-identified patent and that said Letters Patent is hereby corrected as shown below:

Column 4, line 29, Claim 5, insert --said roof adjacent said furnace wall adapted to receive particulate material from said fuel bin and conveying means mounted on said roof adapted to carry charged material from said bin to said opening.--.

Signed and Sealed this

Twenty-seventh Day of October, 1987

*Attest:*

DONALD J. QUIGG

*Attesting Officer*

*Commissioner of Patents and Trademarks*